US007121218B2

(12) United States Patent
Stinson et al.

(10) Patent No.: US 7,121,218 B2
(45) Date of Patent: Oct. 17, 2006

(54) FRONT CONVERSION DECK FOR A BOAT

(75) Inventors: Alan Stinson, Gallatin, TN (US); Greg Strahm, Shelbyville, TN (US)

(73) Assignee: Stratos Boats, Inc., Murfreesboro, TN (US)

( * ) Notice: Subject to any disclaimer, the term of this patent is extended or adjusted under 35 U.S.C. 154(b) by 0 days.

(21) Appl. No.: 10/976,345

(22) Filed: Oct. 28, 2004

(65) Prior Publication Data

US 2006/0090682 A1 May 4, 2006

(51) Int. Cl.
*B63B 3/00* (2006.01)

(52) U.S. Cl. ..... 114/85; 114/363

(58) Field of Classification Search ..... 114/85, 114/363

See application file for complete search history.

(56) References Cited

U.S. PATENT DOCUMENTS

| | | | | |
|---|---|---|---|---|
| 2,472,185 | A * | 6/1949 | Apel | 114/363 |
| 3,052,896 | A | 9/1962 | Beach | |
| 3,475,773 | A | 11/1969 | Codman, Jr. | |
| 4,092,754 | A | 6/1978 | Yost | |
| 4,293,967 | A | 10/1981 | Ord | |
| 4,567,845 | A | 2/1986 | Smith | |
| 4,714,043 | A | 12/1987 | Sheppard | |
| 4,738,217 | A | 4/1988 | Smith | |
| 4,763,598 | A | 8/1988 | Spencer | |
| 4,827,864 | A | 5/1989 | LaMontagne et al. | |
| 4,873,935 | A | 10/1989 | Lustig | |
| 4,922,849 | A | 5/1990 | Wills | |
| 4,960,066 | A | 10/1990 | Wills | |
| 4,979,458 | A | 12/1990 | Bouza | |
| 5,014,370 | A | 5/1991 | Stark, Sr. | |
| 5,170,741 | A | 12/1992 | Magers et al. | |
| D332,935 | S | 2/1993 | Moore | |
| 5,189,977 | A | 3/1993 | Davidson | |
| 5,197,406 | A | 3/1993 | Rabal et al. | |
| 5,375,552 | A | 12/1994 | Scott | |
| 5,497,724 | A | 3/1996 | Brown et al. | |
| 5,894,812 | A | 4/1999 | Dessingue | |
| 5,913,571 | A | 6/1999 | Dystra et al. | |
| 5,975,002 | A | 11/1999 | Rieger | |
| 6,230,648 | B1 | 5/2001 | Davidson et al. | |
| 6,283,059 | B1 * | 9/2001 | Scully, Jr. | 114/363 |
| 6,497,192 | B1 | 12/2002 | Fecht | |
| D483,715 | S | 12/2003 | Montgomery | |
| D485,225 | S | 1/2004 | Montgomery | |
| 6,945,190 | B1 * | 9/2005 | Frandsen | 114/363 |

FOREIGN PATENT DOCUMENTS

| | | |
|---|---|---|
| FR | 2201669 | 5/1974 |
| JP | 02028091 | 1/1990 |

OTHER PUBLICATIONS

"Whatever You Do on the Water, Do it in a Crestliner", 2002 Crestliner Boats catalog, front cover, pp. 8 and 9 and back cover (2001).

U.S. Appl. No. 10/976,172, filed Oct. 28, 2004.

* cited by examiner

*Primary Examiner*—Jesus D. Sotelo
(74) *Attorney, Agent, or Firm*—Merchant & Gould P.C.

(57) ABSTRACT

A convertible bow arrangement for a boat, permitting the bow of the boat to be converted from a flush deck configuration to an open bow configuration. A deck extension is positioned over a footwell in the flush deck configuration and folded beneath and stowed under a forward hatch in the open bow configuration.

15 Claims, 7 Drawing Sheets

FRONT CONVERSION DECK FOR A BOAT

FIELD

The present invention relates generally to boats including a front deck area. More specifically, the present invention relates to conversion of a front deck of a boat between flush deck and open bow configurations.

BACKGROUND

Many pleasure boats sold today are classified as convertible or multi-use boats. Such boats are sold with the accessories for use as a fishing boat, such as trolling motors, depth and fish finders, and live wells, and are also configured for use as runabouts. While it is possible to design many features of such multi-use boats to be compatible with each of their roles, some compromises of desirable features have been necessary in current boats. One of these compromises is the inclusion of an open bow arrangement with a footwell recessed in the front deck of the boat to increase the utility of the boat as a runabout. This footwell may be in the area most desirable for mounting a seat or other support when using the boat for fishing or in the area where a person fishing over the bow of the boat may wish to stand. Improvements to existing boats are desirable to allow more flexible and effective use of a boat for multiple roles.

SUMMARY

The present invention relates to a convertible bow arrangement for a boat. The convertible bow arrangement permits the bow to be changed between a flush deck configuration and an open bow configuration. In the flush deck configuration, a deck extension extends over and closes off the top of the footwell. In the open bow configuration, the deck extension is folded under and stowed beneath a forward hatch. The present invention also relates to a method of converting a bow of a boat from a fluch deck configuration to an open bow configuration.

BRIEF DESCRIPTION OF THE DRAWINGS

The accompanying drawings, which are incorporated in and constitute a part of the description, illustrate several aspects of the invention and together with the detailed description, serve to explain the principles of the invention. A brief description of the drawings is as follows.

DETAILED DESCRIPTION OF THE PREFERRED EMBODIMENT

Reference will now be made in detail to exemplary aspects of the present invention which are illustrated in the accompanying drawings. Wherever possible, the same reference numbers will be used throughout the drawings to refer to the same or similar parts.

Figure 1:
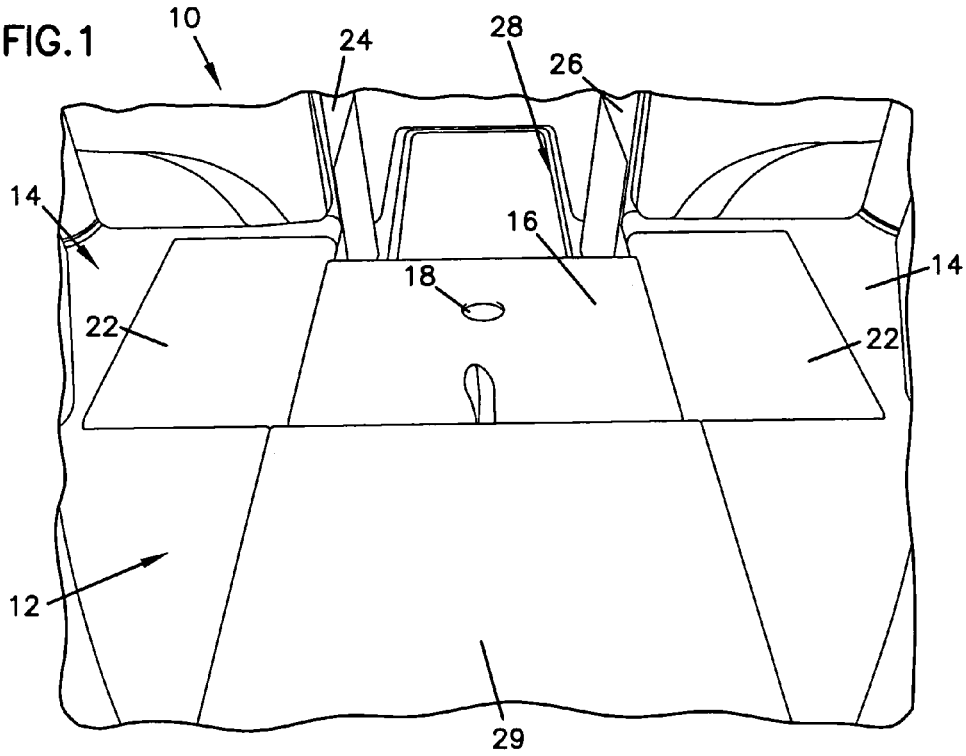
FIG. 1 is a front perspective view of a front deck of a boat according to the present invention.

In FIG. 1, a front deck 12 of a boat 10 is shown in a flush deck configuration. Such a configuration may be used, for example, as a casting platform for fishing. While this flush deck configuration is desirable for fishing, it less desirable for pleasure boat usage, as seating in the bow area of boat 10 is limited. This limits the overall space available for passengers in boat 10. For fishing purposes, typically fewer passengers are carried so the relative lack of seating space is not an issue.

Front deck 12 includes a pair of seating areas 14 positioned adjacent a central deck extension 16. Central deck extension 16 includes an opening 18 for receiving a mounting post for a raised fishing seat or leaning post to be installed in front deck 12 for use in the shown flush deck configuration. Toward the bow of boat 10 relative to deck extension 16 is a forward hatch 20. Within each seating area 14 may be a side hatch 22. Toward the stern of boat 10 relative to seating areas 14 are a helm station 24 and a passenger seat 26 with an opening 28 defined therebetween.

Figure 2:
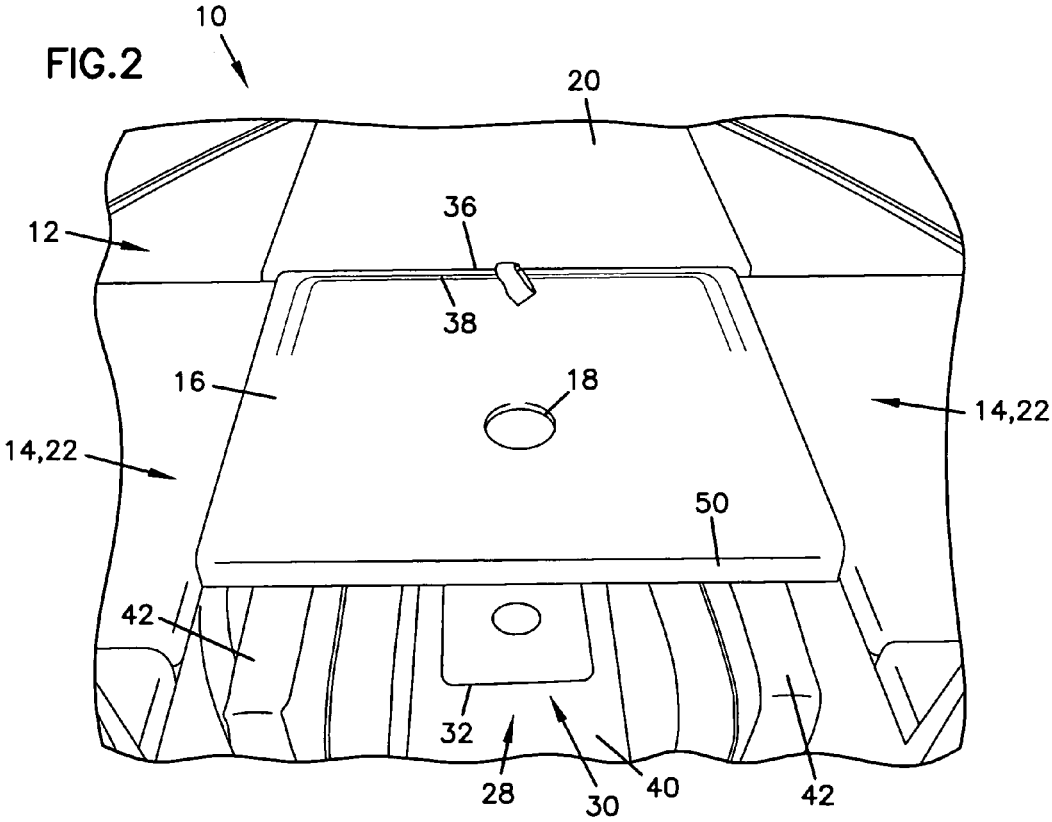
FIG. 2 is a rear opposite perspective view of the boat and the front deck of FIG. 1.
Figure 3:
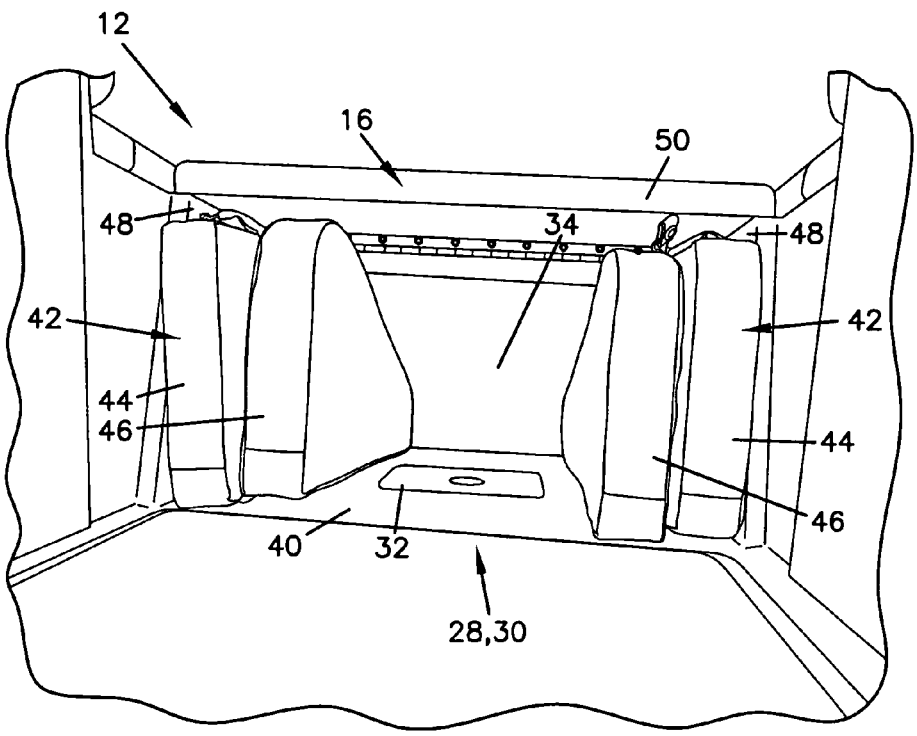
FIG. 3 is a lower rear view of the boat of FIG. 1, showing a footwell beneath the front deck.

Referring now to FIG. 2, extending forward from opening 28 is a footwell 30 beneath deck extension 16, to a forward bulkhead 34 (shown in FIG. 3). Forward bulkhead 34 is generally situated under a rear edge 36 of hatch 20 and a forward edge 38 of deck extension 16. Footwell 30 includes a lower deck 40 in which may be a seat mounting post receiver 32, positioned beneath opening 18 of deck extension 16. Within footwell 30 are a pair of seat cushions 42, each folded at least partially back onto itself, with one cushion 42 along either side of footwell 30.

FIG. 3 shows footwell 30 through opening 28, extending to forward bulkhead 34. Each folded cushion 42 includes a first portion 44 adjacent a side wall 48 of footwell 30 and a second portion 46. Portions 44 and 46 of cushions 42 are sized to fold and fit between deck extension 16 and floor 40. Deck extension 16 includes a rear edge 50 defining a rearward limit of deck extension 16 above footwell 30.

Figure 4:
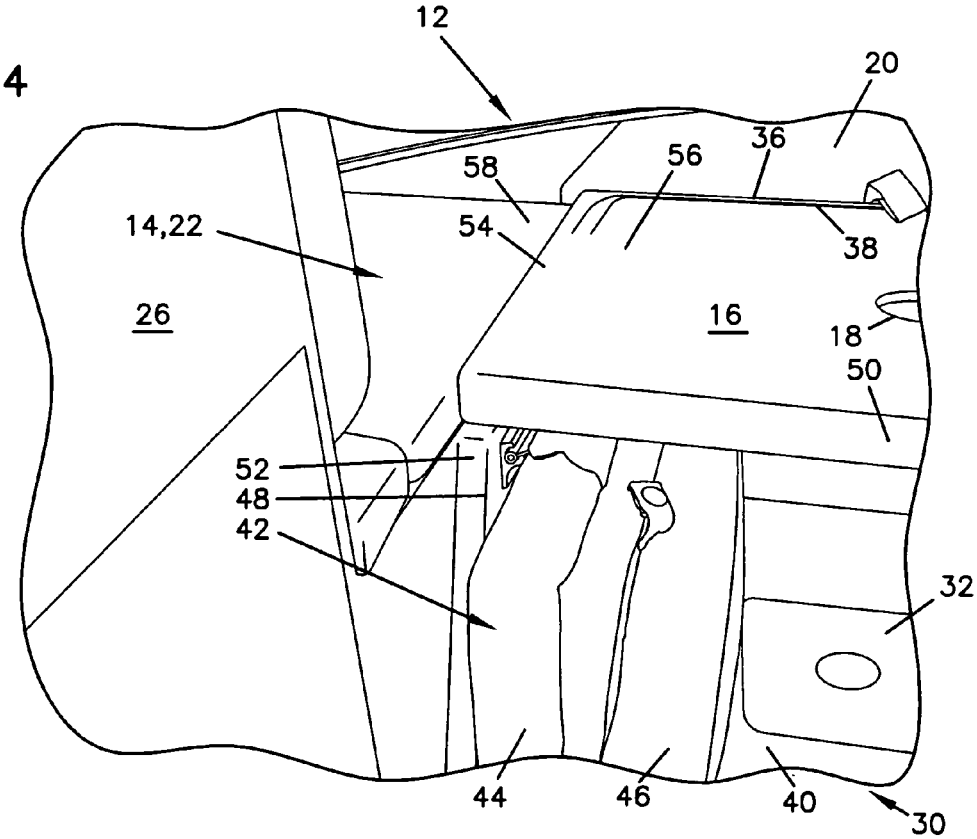
FIG. 4 is a closer view of a seat cushion stored within the footwell of FIG. 3.

In FIG. 4, each side wall 48 of footwell 30 defines a rail 52 adjacent seating area 14 and locker 22. Rail 52 engages deck extension 16 along a side edge 54 and supports deck extension 16 above footwell 30. Rail 52 is recessed beneath an upper surface 58 of seating area 14 so that an upper surface 56 of deck extension 16 is generally flush with upper surface 58. This provides a generally level and even raised casting platform for front deck 12 in the configuration shown in FIGS. 1 and 2.

Figure 5:
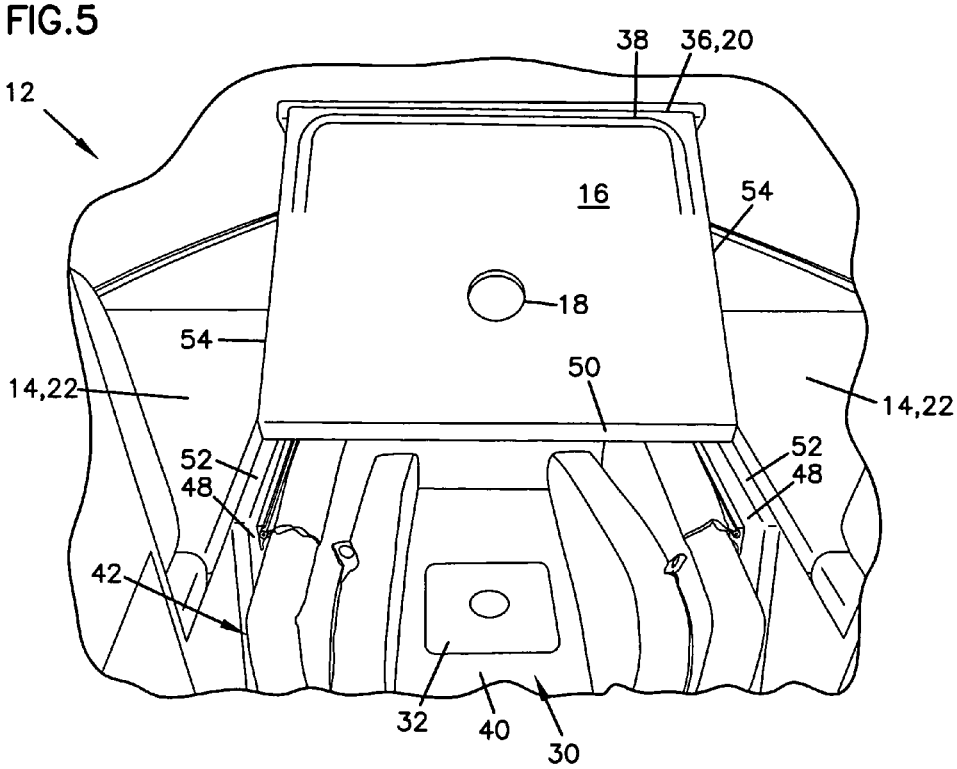
FIG. 5 is a rear perspective view of the boat and the front deck of FIG. 2, with a movable deck extension partially removed from above the footwell of the front deck in a first intermediate position.
Figure 6:
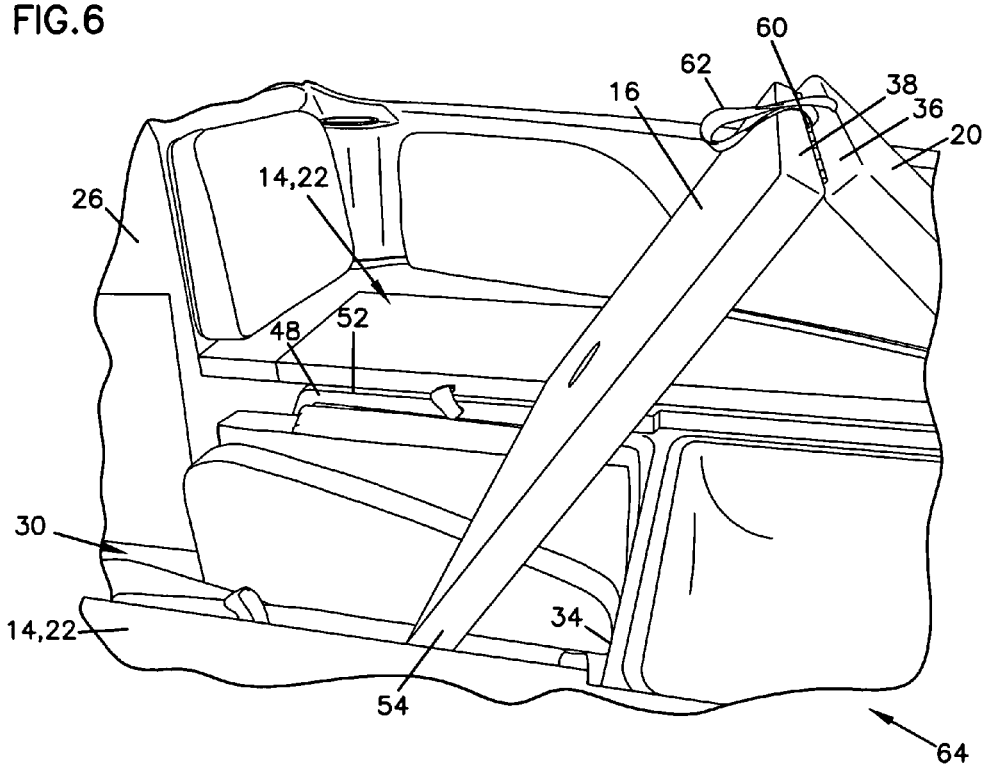
FIG. 6 is a side perspective view of the partially removed deck extension of FIG. 5 in a second intermediate position.
Figure 7:
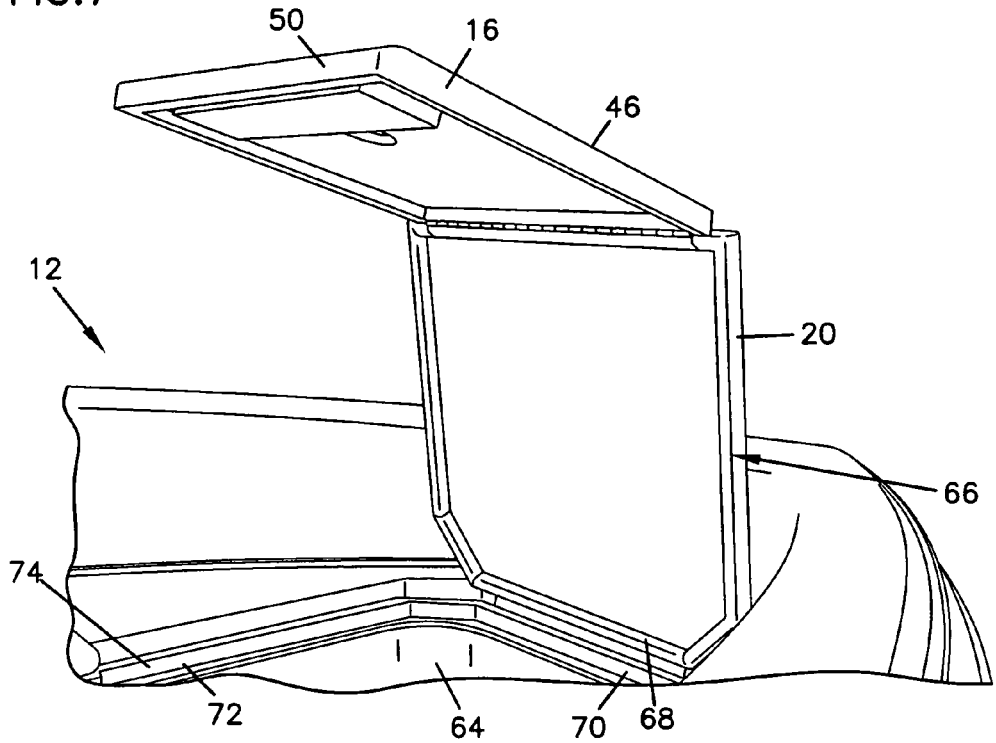
FIG. 7 is a side perspective view of the deck extension of the boat of FIG. 5, with the deck extension removed from above the footwell of the boat.

FIGS. 5 and 6 show deck extension 16 raised partially from above footwell 30. Rear edge 36 and front edge 38 are pivotably connected to each other by a hinge 60. Hatch 20 is raised above a bow locker 64 and may include a handle 62 to aid in raising hatch 20 and deck extension 16 to the intermediate positions shown in FIGS. 5 and 6. Raising deck extension 16 and hatch 20 to the intermediate positions shown in the FIGS. are steps in the process of converting front deck 12 of boat 10 between a flush deck configuration and an open bow configuration. FIG. 7 shows hatch 20 fully opened from above bow locker 64 and in position to have deck extension 16 adjacent a lower surface 66 of hatch 20 with upper surface 56 of deck extension 16 facing down toward bow locker 64. A front edge 68 of hatch 20 is hingedly mounted adjacent a front edge 70 of bow locker 64. Hatch 20 is sized so that deck extension 16 can fold along hinge 60 and rest adjacent lower surface 66 with rear edge 50 adjacent front edge 68.

Figure 8:
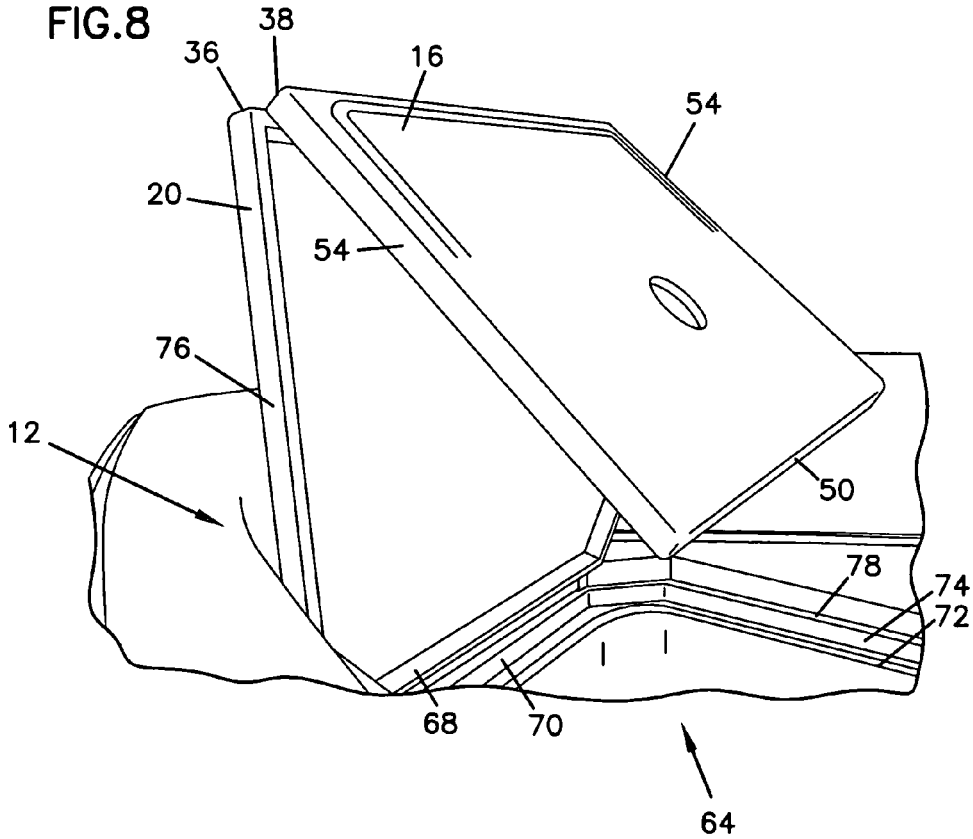
FIG. 8 is a side perspective view of the deck extension of the boat of FIG. 7, with the deck extension partially folded underneath a lid of a forward deck locker.

Bow locker 64 includes a peripheral lip 72 extending along the sides of an opening 74 providing access into bow locker 64. Opening 74 is closed off by hatch 20 when hatch 20 is in a closed position. When hatch 20 is in a closed position and deck extension 16 is folded underneath lower surface 66, peripheral lip 72 may engage one or more edges 38, 50 and 54 of deck extension 16 and hold deck extension 16 against lower surface 66. FIG. 8 shows deck extension 16 being folded closer adjacent to lower surface 66 of hatch 20.

As shown in FIG. 8, hatch 20 includes sides 76 extending generally between front edge 68 and rear edge 36. Adjacent opening 74 are defined shoulders 78 which engage sides 76 when hatch 20 is in a closed position. Shoulders 78 and peripheral lip 72 are spaced apart from each other sufficiently to permit deck extension 16 to be stowed beneath hatch 20 and above peripheral lip 72 and permit hatch 20 to lie generally flush with the remainder of upper surface 58 of front deck 12.

Figure 9:
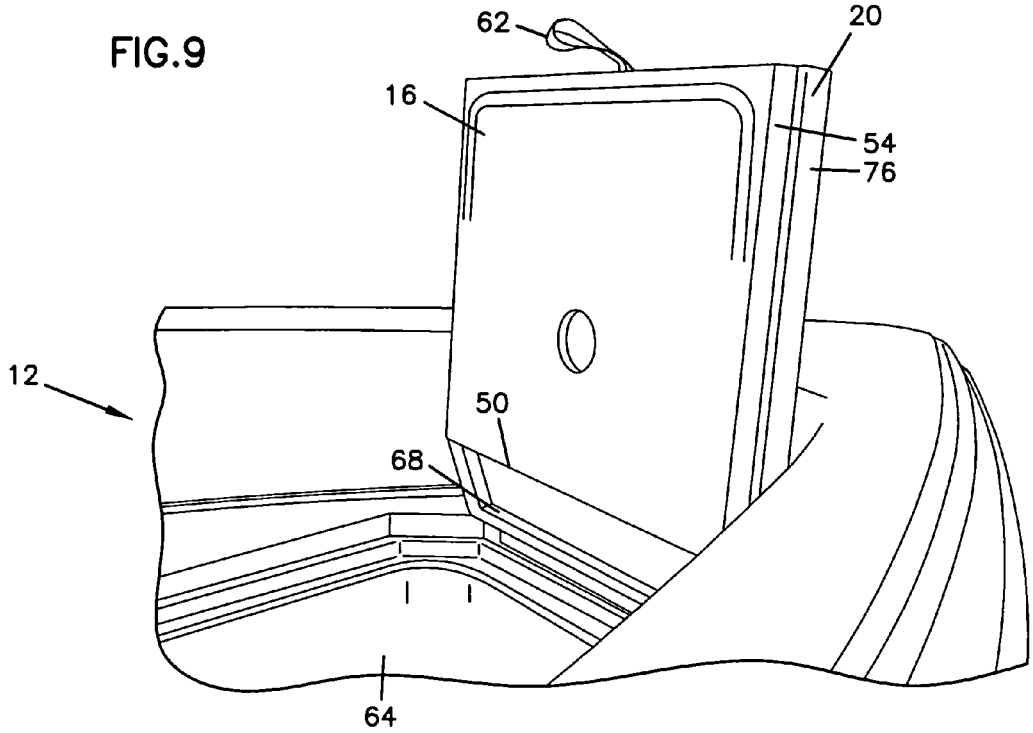
FIG. 9 is a side perspective view of the deck of extension of FIG. 8, with the deck extension folded underneath the lid of the forward locker.
Figure 10:
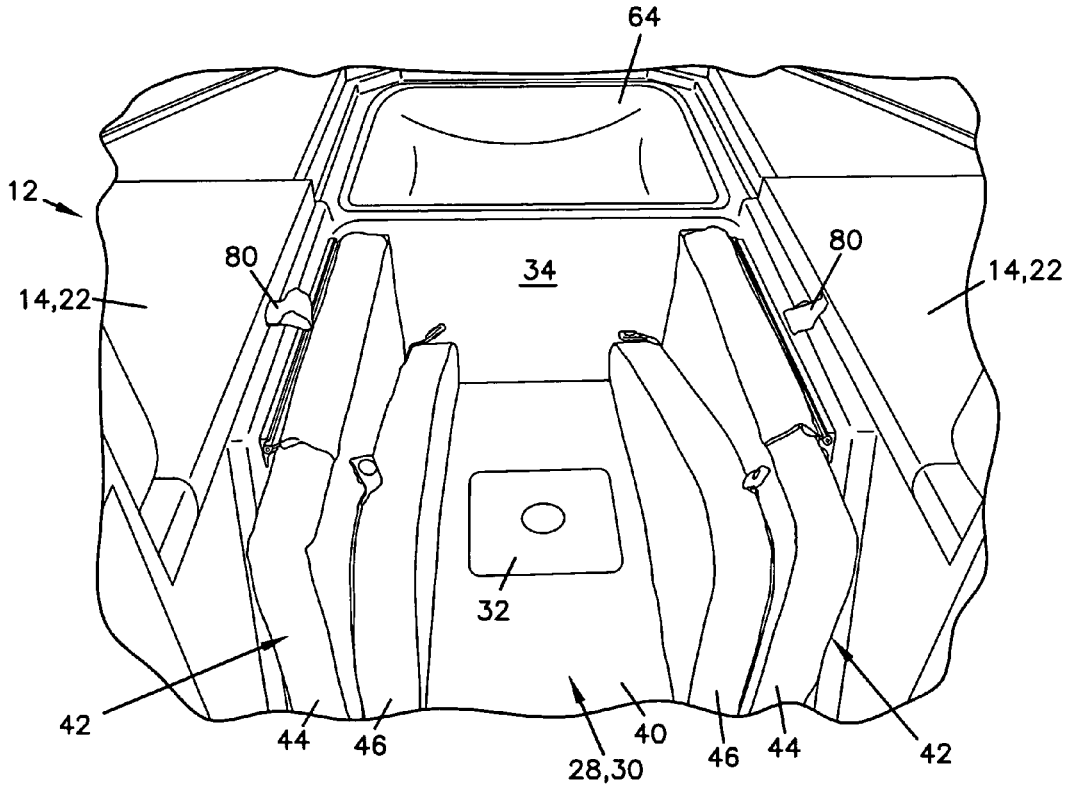
FIG. 10 is a rear perspective view of the front deck of the boat with the deck extension removed from above the footwell and folded seat cushions stowed within the footwell.

FIG. 9 shows deck extension 16 resting against lower surface 66 of hatch 20. Note that side edges 54 of deck extension 16 are entirely contained within sides 76 of hatch 20 and that rear edge 50 of deck extension 16 does not overlap front edge 68 of hatch 20. FIG. 10 shows cushions 42 within footwell 30, with deck extension 16 removed from above footwell 30 to permit access to cushions 42. Also shown in FIG. 10 is a strap 80 attached to each of the side hatches 22. These straps 80 permit easier grasping and opening of lids closing side hatches 22. Straps 80 may be held beneath deck extension 16, as shown in FIGS. 1, 2 and 4, above, or positioned above deck extension 16 in the flush deck configuration to aid access to interiors of side hatches 22.

Figure 11:
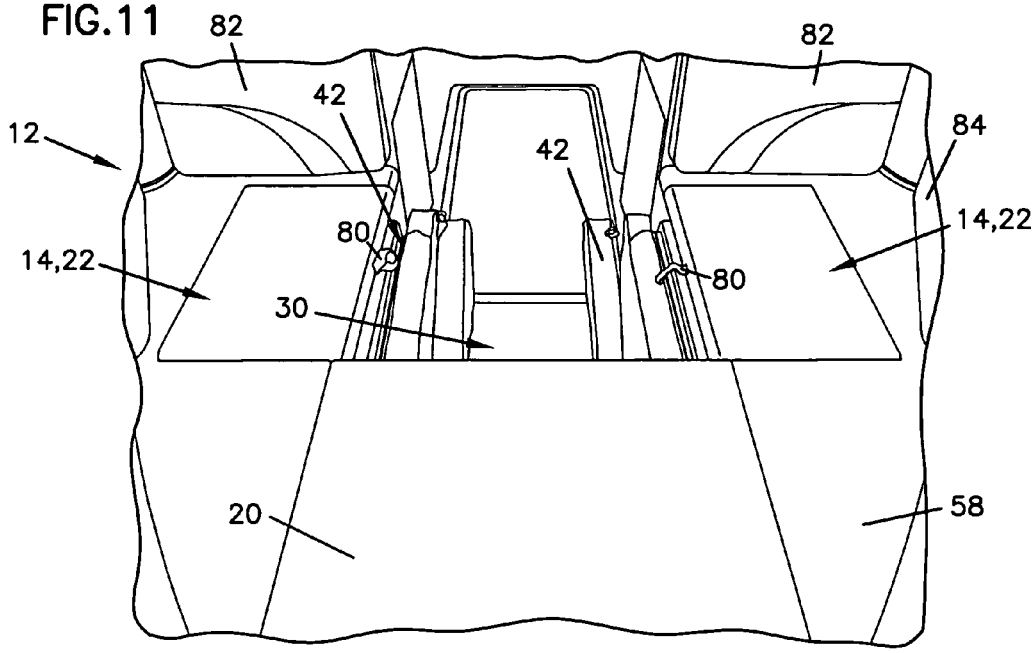
FIG. 11 is a front perspective view of the front deck of the boat of FIG. 1, with the deck extension removed from above the footwell and folded underneath the lid of the forward deck locker and stowed within the forward deck locker, and folded seat cushions stowed within the footwell.

FIG. 11 shows bow 12 with deck extension 16 stowed beneath hatch 20 and hatch 20 repositioned closing off bow locker 64. Deck extension 16 is completely stowed away and hatch 20 is flush with deck surface 58. Cushions 42 remain folded and in a stowed position within footwell 30, permitting access to side latches 22, or use of seating locations 14 without additional padding on top of deck surface 58. A fixed back cushion 82 may be positioned along a rear wall and along an outer wall adjacent the gunwale may be a side bolster 84 at each seating location 14.

Figure 12:
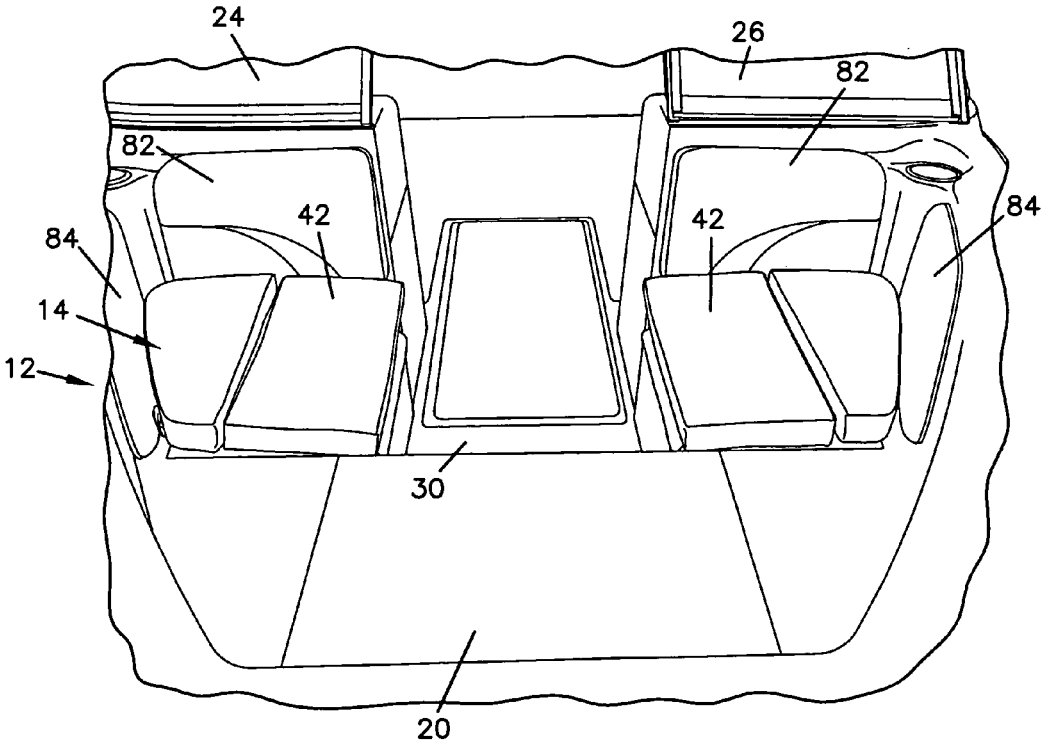
FIG. 12 is a front perspective view of the front deck of the boat of FIG. 11, with one of the seat cushions positioned atop each of a pair of adjacent seating area of the front deck on either side of the footwell.
Figure 13:
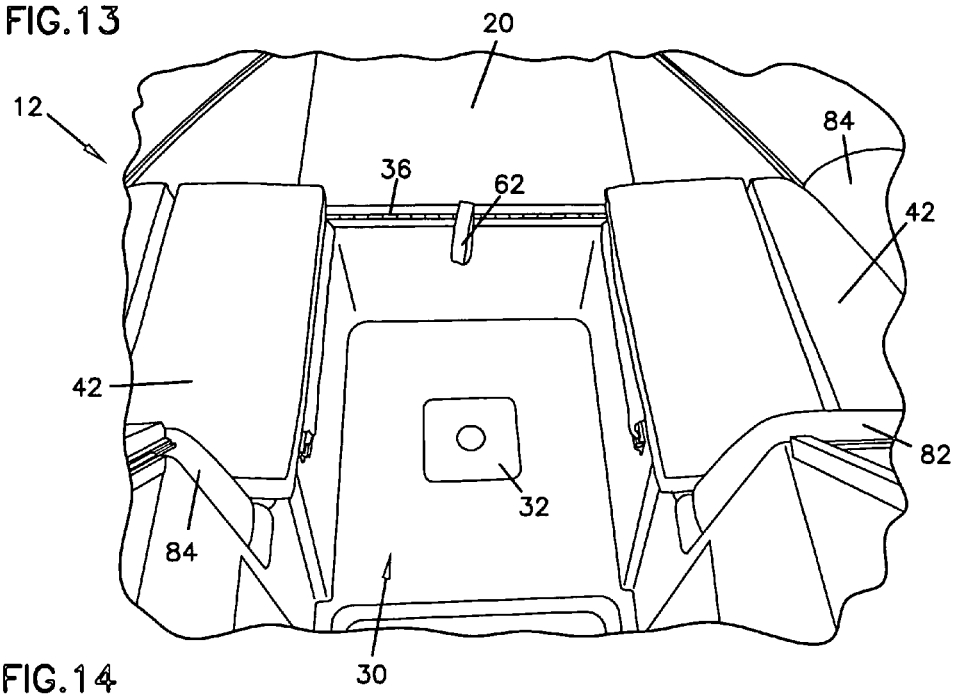
FIG. 13 is a rear perspective view of the front deck of the boat of FIG. 12.

FIGS. 12 and 13 show cushions 42 removed from footwell 30, unfolded and placed in a seating position atop each of the seating locations 14. Footwell 30 is now completely open and bow 12 is in an open bow or runabout configuration.

Figure 14:
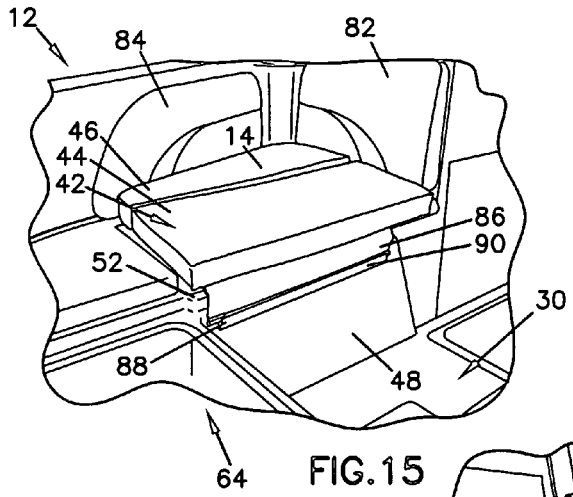
FIG. 14 is a side perspective view of the front deck of the boat of FIG. 12.

Referring now to FIG. 14, one of the cushions 42 is shown with first portion 44 and second portion 46 lying flat atop one of the seating locations 14. Along one side of first portion 44 adjacent footwell 30 is a web 86 including a bead 88. Bead 88 is slidably received within a groove 90 positioned on sidewall 48 within footwell 30, just below rail 52. Bead 88 and groove 90 cooperate to slidably and removably mount cushion 42 within footwell 30 and permit removal or replacement of cushion 42 within footwell 30 or on seating location 14. Web 86 is preferably made from a fabric or similar material which is flexible enough to permit easy movement between a folded and stowed position and an unfolded seating position. Such a flexible web may also facilitate ease of insertion of removal of bead 88 from groove 90. In FIGS. 4 and 5, bead 88 is shown within groove 90.

Figure 15:
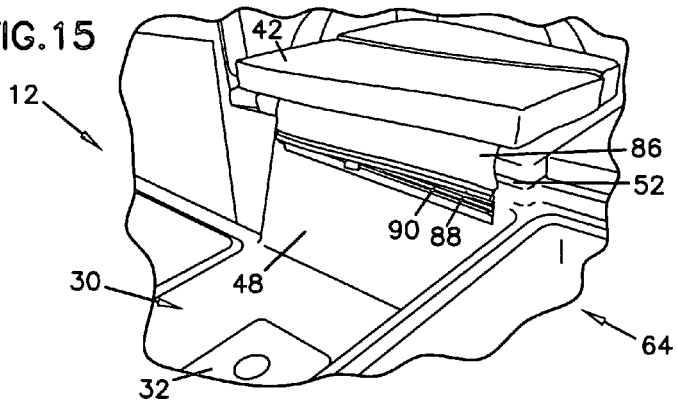
FIG. 15 is a side perspective view of a mounting slide for mounting one of the seat cushions within the footwell of the boat of FIG. 12.

In FIG. 15, bead 88 is shown removed from groove 90 with cushion 42 atop seating location 14. With bead 88 removed as shown, cushion 42 may be positioned atop seating location 14, or removed from bow 12 to permit access to side hatch 22 or use of the seating location 14 without extra padding.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A retractable deck platform for a boat comprising:

a deck defining an upper surface and including an area recessed beneath the upper surface and a deck locker adjacent the recessed area;

a locker cover positioned above the deck locker closing off an opening of the deck locker;

a pair of seating areas on the upper surface of the deck on opposite sides of the recessed area; and, a deck extension sized to fit on top of the recessed area and rest generally even with the upper surface of the deck, the deck extension hingedly mounted to the locker cover and movable between a first position folded underneath the locker cover within the deck locker, and a second position extended from the locker cover over the recessed area.

2. The retractable deck platform of claim 1, further comprising a pair of folding seat cushions, each cushion attached to a side wall within the recessed area beneath the upper surface of the deck adjacent one of the seating areas, and movable between a seating position on the adjacent seating area and a stowed position within the recessed area.

3. The retractable deck platform of claim 1, wherein the recessed area includes a floor extending between the side walls, a seat mount is included in the floor, and an opening to receive a seat pillar is defined in the deck extension above the seat mount in the floor.

4. The retractable deck platform of claim 1, wherein the seat cushions include a bead along one side and a mating groove is mounted to the side wall within the recessed area, the groove slidably receiving the bead to hingedly mount the cushion to the side wall.

5. The retractable deck platform of claim 1, wherein the opening of the deck locker includes at least one ridge positioned about an inner perimeter of the opening, the deck extension held beneath and generally parallel to the locker cover in the first position.

6. The retractable deck platform of claim 1, wherein each of the sidewalls of the recessed area includes a ledge, the deck extension resting on the ledges when in the second position.

7. The retractable deck platform of claim 1, wherein recessed area includes a floor extending between the sidewalls and the folding seat cushions in the second position fold along an intermediate seam to stow in the recessed area beneath the deck extension.

8. A method of converting a bow of a boat from a flush deck configuration to an open bow configuration, the method comprising:

providing a central footwell in the bow opening toward a stern of the boat with a deck extension extending rearward from a forward end of the footwell between two seating locations on an upper surface of a deck on either side of the footwell, the deck extension extending between the seating positions over the footwell and hingedly attached to a hatch along a front end, the hatch covering a bow locker;

raising the hatch from the bow locker and raising the front end of the deck extension, and moving the deck extension from over the footwell;

folding the deck extension beneath a lower surface of the hatch;

lowering the hatch to cover the bow locker with the deck extension folded beneath the lower surface and positioned between the bow locker and the hatch.

9. The method of claim 8, further comprising providing at least one cushion within the footwell beneath the deck extension and removing the cushion from the footwell after the deck extension is positioned between the hatch and the bow locker and placing the cushion atop one of the seating locations adjacent the footwell.

10. A convertible bow for a boat comprising:

a deck defining an upper surface and including an area recessed beneath the upper surface;

a pair of seating areas on the upper surface of the deck on opposite sides of the recessed area; and, a deck extension sized to fit on top of the recessed area and rest generally even with the upper surface of the deck;

a pair of folding seat cushions, each cushion attached to a side wall within the recessed area beneath the upper surface of the deck adjacent one of the seating areas, and movable between a seating position on the adjacent seating area and a stowed position within the recessed area beneath the upper surface of the deck.

11. The convertible bow of claim 10, wherein the folding seat cushions each include a first portion and a second portion and are foldable along a line generally parallel to the sidewall of the recessed area.

12. The convertible bow of claim 11, wherein the first and second portions of each folding seat cushion in the stowed position are generally vertical within the recessed area and are positioned adjacent the sidewall of the recessed area to which the seat cushion is attached.

13. The convertible bow of claim 10, wherein the folding seat cushion is attached the sidewall of the recessed area by a flexible web between the first portion and a mount on the sidewall wall adjacent an upper edge of the sidewall.

14. The convertible bow of claim 13, wherein the mount on the sidewall is a groove, the folding seat cushion includes a bead attached to the flexible web, and the bead is slidably and removably received within the groove.

15. The convertible bow of claim 11, further comprising a deck locker adjacent the recessed area, a locker cover positioned above the deck locker closing off an opening of the deck locker, and the deck extension hingedly mounted to the locker cover and movable between a first position folded underneath the locker cover within the deck locker, and a second position extended from the locker cover over the recessed area.

* * * * *